US007218053B2

(12) United States Patent
Bowler et al.

(10) Patent No.: US 7,218,053 B2
(45) Date of Patent: May 15, 2007

(54) ELECTRON BEAM TUBE OUTPUT ARRANGEMENT

(75) Inventors: Darrin Bowler, Chelmsford (GB); Anthony Joel Challis, Halstead (GB); Anthony James Tokeley, Maldon (GB)

(73) Assignee: E2V Technologies (UK) Limited, Chelmsford, Essex (GB)

( * ) Notice: Subject to any disclaimer, the term of this patent is extended or adjusted under 35 U.S.C. 154(b) by 0 days.

(21) Appl. No.: 11/312,840

(22) Filed: Dec. 21, 2005

(65) Prior Publication Data

US 2006/0158139 A1 Jul. 20, 2006

(30) Foreign Application Priority Data

Dec. 24, 2004 (GB) ..... 0428379.2

(51) Int. Cl.
*H01J 25/50* (2006.01)

(52) U.S. Cl. ..... 315/39.53; 315/39.77; 315/5.37; 315/5.38; 315/3.5; 330/44

(58) Field of Classification Search ..... 315/3.5, 315/4, 5, 5.27, 5.35, 5.37, 5.38, 5.51, 39.51, 315/39.53, 39.75, 39.77; 330/44, 45
See application file for complete search history.

(56) References Cited

U.S. PATENT DOCUMENTS 3,942,136 A * 3/1976 Heynisch et al. ..... 332/103
4,682,076 A 7/1987 Kageyama et al.
6,998,783 B2 * 2/2006 Symons ..... 315/5.37

* cited by examiner

*Primary Examiner*—Haissa Philogene
(74) *Attorney, Agent, or Firm*—Venable LLP; Robert Kinberg

(57) ABSTRACT

An electron beam tube of the type for amplification of RF signals comprising an electron gun, an interaction region within a vacuum, an RF input and an RF output arrangement, the RF output arrangement comprising an output coaxial line and a coaxial divider, wherein the coaxial divider is arranged to divide a signal on the coaxial line into a plurality of signals and wherein the vacuum within the interaction region extends into the coaxial divider.

11 Claims, 2 Drawing Sheets

ELECTRON BEAM TUBE OUTPUT ARRANGEMENT

CROSS-REFERENCE TO RELATED APPLICATION

This application claims the priority of British Application No. 0428379.2, filed on Dec. 24, 2004, the subject matter of which is incorporated herein by reference.

BACKGROUND OF THE INVENTION

This present invention relates to an output arrangement for electron beam tubes, and to a travelling wave tube incorporating an output arrangement.

Electron beam tubes are used for the amplification of RF signals and are typically linear beam devices. There are various types of linear electron beam tube known to those skilled in the art, examples of which include the Travelling Wave Tube (TWT), the klystron and the Inductive Output Tube (IOT). Linear electron beam tubes incorporate an electron gun for the generation of an electron beam of an appropriate power. The electron gun includes a cathode heated to a high temperature so that the application of an electric field between the cathode and an anode results in the emission of electrons. Typically, the anode is held at ground potential and the cathode at a large negative potential of the order of tens of kilovolts.

Electron beam tubes used as amplifiers broadly comprise three sections. An electron gun generates an electron beam, which is modulated by application of an input signal. The electron beam then passes into a second section known as the interaction region, which is surrounded by a cavity arrangement including an output cavity arrangement from which the amplified signal is extracted. The third stage is a collector, which collects the spent electron beam.

In an inductive output tube (IOT) a grid is placed close to and in front of the cathode, and the RF signal to be amplified is applied between the cathode and the grid so that the electron beam generated in the gun is density modulated. The density modulated electron beam is directed through an RF interaction region, which includes one or more resonant cavities, including an output cavity arrangement. The beam may be focused by a magnetic means to ensure that it passes through the RF region and delivers power at an output section within the Interaction region where the amplified RF signal is extracted. After passing through the output section, the beam enters the collector where it is collected and the remaining power is dissipated. The amount of power which needs to be dissipated depends upon the efficiency of the linear beam tube, this being the difference between the power of the beam generated at the electron gun region and the RF power extracted in the output coupling of the RF region.

In a klystron the input signal velocity modulates an electron beam, which then enters a drift space in which electrons that have been speeded up catch up with electrons that have been slowed down. The bunches are thus formed in the drift space, rather than in the gun region itself, as in an IOT which density modulates the beam.

A Travelling Wave Tube (TWT) can be thought of as a modified type of klystron. In a TWT, a velocity-modulated beam interacts with an RF circuit known as a slow wave structure, typically either a helix or a series of cavities coupled to one another, to produce amplification at microwave frequencies. In the cavity type, the resonant cavities are coupled together with a transmission line. The electron beam is velocity modulated by an RF input signal at the first resonant cavity, and induces RF voltages in each subsequent cavity. If the spacing of the cavities is correctly adjusted, the voltages at each cavity induced by the modulated beam are in phase and travel along the transmission line to the output, with an additive effect, so that the output power is much greater than the power input.

The helix type TWT differs from other electron tubes in that it does not use RF cavities, but uses a conductive helix along which the RF wave travels. The RF energy travels along the helix wire at the velocity of light. However, because of the helical path, the energy progresses along the axial length of the tube at a considerably lower axial velocity, and hence the name "slow wave" circuit. The purpose of the slow wave structure, as in any electron beam RF interaction circuit, is to transfer energy from the electron beam to the RF signal for output. This occurs by interaction between the axial component of the electric field wave travelling down the centre of the helix and the electron beam moving along the axis of the helix at the same time. The electrons are continually slowed down as their energy transferred to the wave along the helix.

The two known types of TWT are shown in FIGS. 1 and 2. First, in FIG. 1, a TWT comprises an electron gun 14, an interaction region or circuit 18 and a collector 16. In this type of TWT, the interaction circuit comprises a series of cavities 20 coupled by a transmission line. An input 10 feeds an RF signal into the first cavity and an output 12 extracts the amplified RF signal from the TWT. Second, in FIG. 2, a TWT of the helix type comprises an electron gun 14, an interaction circuit 18 and a collector 16 as before. The interaction circuit comprises a conductive helix 4 along which the RF signal travels from an input coaxial line 7 to an output coaxial line 8. As the cavity comprises a vacuum enclosed by envelope 22, insulative rings 7A, 8A between the inner and outer conductors of the input and output coaxial lines provide a vacuum seal. An example of the helix type TWT is known from U.S. Pat. No. 4,682,076. Other known TWTs are the ring bar TWT and ring loop TWT.

With electron beam tubes that have resonant cavities, as described above, the coupling of output power is typically by an inductive loop. Where more than one output is required, more than one inductive loop may be used. However, with TWTs such as the helix type, we have appreciated that there are difficulties in providing more than one output coupling due to impedance constraints.

We have appreciated the need to improve output arrangements of electron beam tubes. In particular, we have appreciated the need to provide division of output power from devices such as TWTs in particular the helix type.

SUMMARY OF THE INVENTION

The invention is defined in the claims to which reference is now directed.

Current technology for transmission of RF signals from TWTs is for a single output transmission line in either coaxial or waveguide line. For systems requiring a dual output either two TWTs need to be employed or, the output of the TWT has to radiate into a waveguide power divider or splitter. Both of these systems are inherently higher mass and volume, with consequential cost implications.

The embodiment of the invention enables the amplified RF signal transmitted from a travelling wave tube (TWT) to be divided, from a single output signal into two or more output signals. Each of the transmitted outputs being of the same frequency and equivalent power levels. The divider forms an integral part of the TWTs RF output section and as such is capable of transmitting high power RF signals over a broad bandwidth. The size and mass of the divider are minimised by incorporating the divider inside the vacuum envelope of the TWT. This makes the TWT/divider combination suitable for airborne applications where stringent conditions are encountered. Such conditions include wide temperature ranges (e.g. from −55° C. to >200° C.) and high altitude (70 Kft).

BRIEF DESCRIPTION OF THE DRAWINGS

An embodiment of the invention will now be described, by way of example only, and with reference to the accompanying drawings, in which.

DETAILED DESCRIPTION OF THE INVENTION

Figure 1:
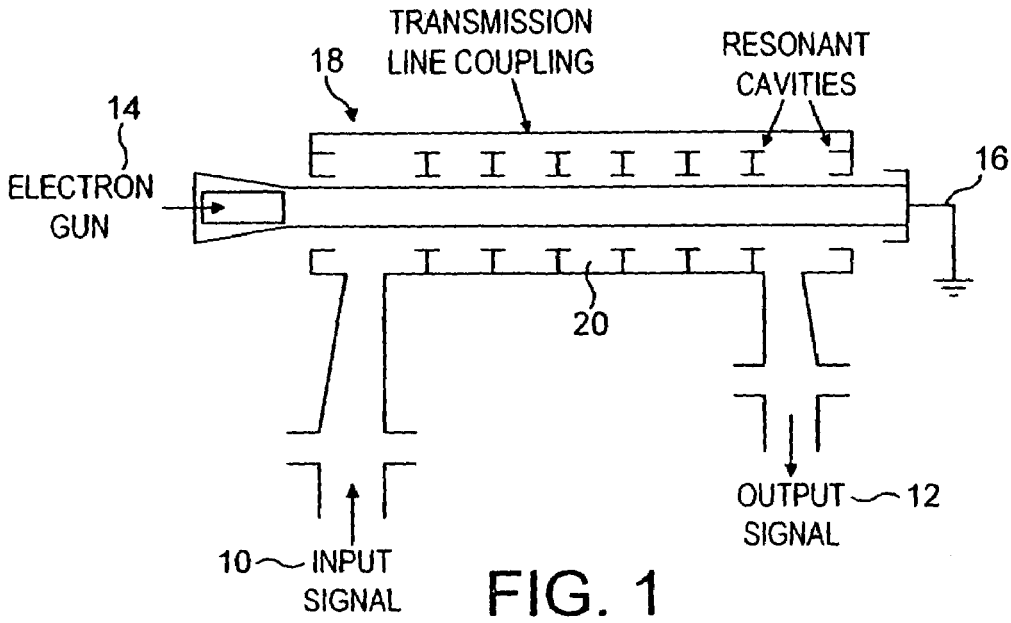
FIG. 1 (PRIOR ART)
FIG. 1: is a schematic view of a known cavity type TWT.
Figure 2:
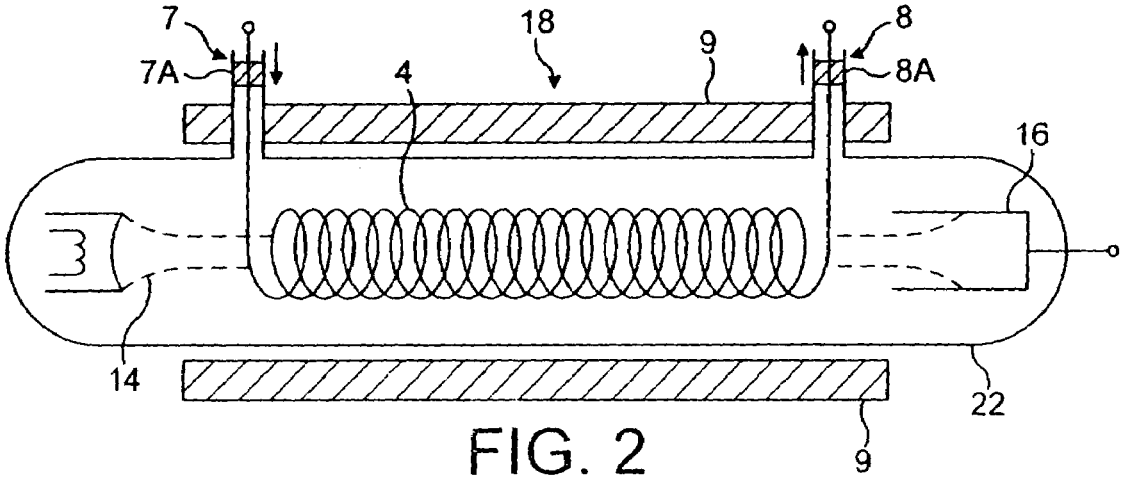
FIG. 2 (PRIOR ART)
FIG. 2: is a schematic view of a known helix type TWT.

The embodiment described in a helix type travelling wave tube (TWT) but the invention may be applied to other electron beam devices such as those described above. The main components of a known helix type TWT have already been described and are briefly repeated for ease of reference with respect to the schematic arrangement of FIG. 2 which may be altered to embody the invention as shown in FIG. 3.

The TWT comprises an electron gun 14, an RF interaction circuit 18 in the form of a helix 4 and a collector 16. An input coaxial line 7 provides an RF input and an output coaxial line 8 takes the RF output. Seals 7A, 8A at the input and output close the vacuum shown schematically as an envelope 22.

Figure 3:
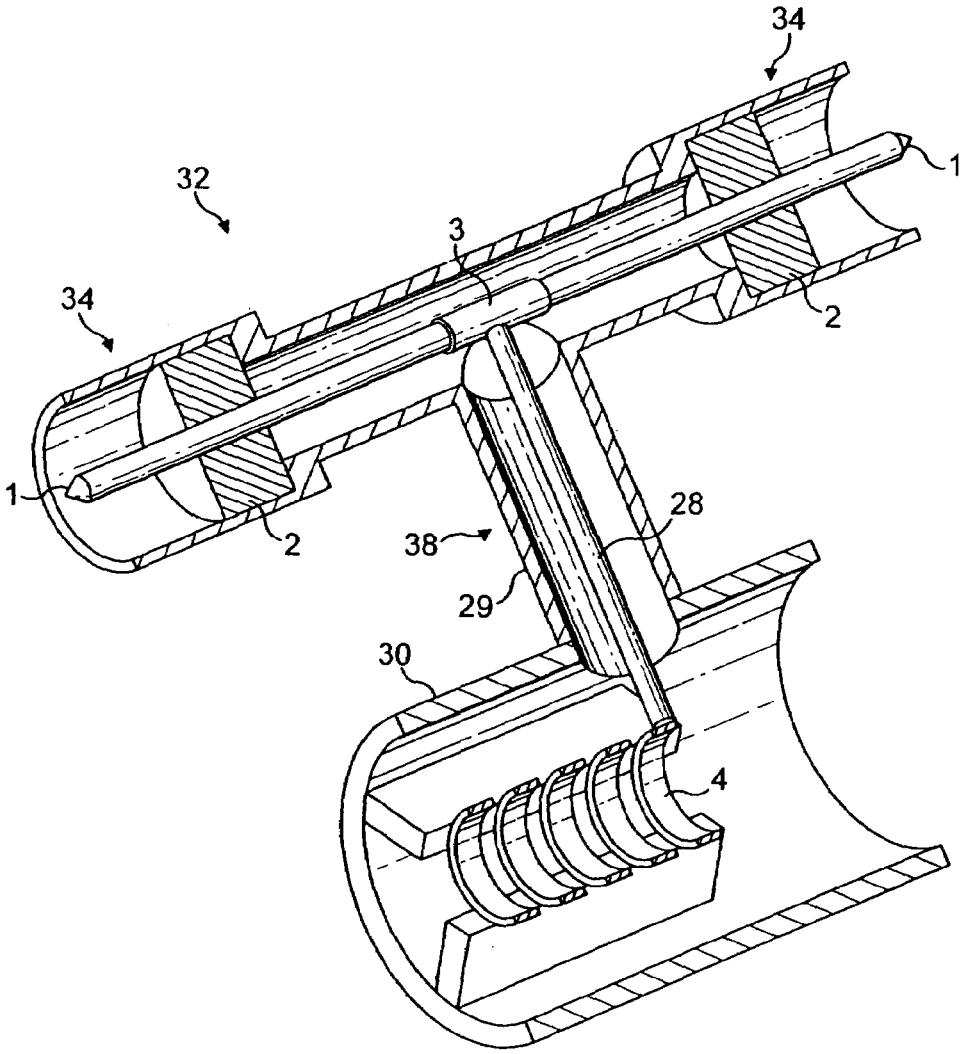
FIG. 3: is a schematic view of an output portion of a helix type TWT embodying the invention.

The TWT embodying the invention has a modified output arrangement shown in FIG. 3. A portion of the helix 4 in the RF interaction circuit is shown and connects to the central conductor 28 of an output coaxial line 38 in known fashion. The outer housing 30 of the TWT tube connects to the outer conductor 29 of the coaxial line 38 so that the vacuum within the TWT tube extends into the output coaxial line. The output coaxial line 8 is thus part of the vacuum envelope of the TWT.

The output coaxial line 38 connects to a coaxial divider 32 here comprising two further coaxial lines joined at right angles to the output coaxial line and in opposing directions to one another. The central conductor 28 of the output coaxial line joins the central conductors 1 of the two further lines at a junction 3. The outer conductors of the coaxial lines are all joined so as to have vacuum tight joints and are included in the vacuum envelope. Seals 2 are provided in the further coaxial lines to create a vacuum tight seal between the inner and outer conductors to close the vacuum envelope.

The embodiment of the invention enables the use of one single travelling wave tube to transmit two high power RF signals in two opposing directions. The single device avoids the need for two TWTs each transmitting a single RF output signal. This is of particular interest for airborne devices, where limitations on cost, mass and volume are critical.

As already described, the embodiment of the invention contains a single output coaxial transmission line emanating from the RF structure. The centre conductor of the output coaxial line starts from the helix slow wave structure contained within the vacuum envelope. The dielectric constant of the coaxial line is set by the vacuum of the TWT because the output line itself is within the vacuum envelope. The coaxial divider 32 splits the single output coaxial transmission line into two equally matched lines 34, all contained within the vacuum envelope. This enables the transmission of broadband high power RF signals to be divided into two signals equal in frequency and magnitude. The two outputs of the divider each terminate in a high power hermetically sealed ceramic window 2. This forms the vacuum seal to the TWT and the RF outputs. When integrated into a system these two RF outputs will be directly connected to transmitting antennas via high power coaxial cables.

The arrangement allows the division of high power RF energy whilst minimising losses by providing good impedance matching. In the embodiment described, operation parameters are typically 4.5 kV, 100 Watt continuous wave output. At such power levels, heating would be a problem. However, the embodiment matches the impedance of the output coaxial line to the TWT, and the impedance of the output coaxial line to the coaxial divider by having the same dielectric present throughout, namely a vacuum. Naturally, a perfect vacuum is not essential, and the term "vacuum" is used herein to describe a vacuum sufficient for normal operation of a TWT as known to the skilled person. The characteristic impedance of the output coaxial line 38 and each of the two further coaxial lines 34 is thus the same due to the presence of the same dielectric (vacuum) and the equal sizes of components. Power is thus equally split into each of the two further coaxial lines 34.

The embodiment of the invention provides a neat arrangement for splitting RF power from an electron beam tube to provide the power in two or more directions. Whilst two coaxial transmission lines are shown and described, further arrangements would be possible, such as four coaxial lines, each at right angles, or other numbers of lines.

Other possible arrangements include arranging the two or more further coaxial lines at other angles and not necessarily at right angles. For example, one coaxial line 34 could extend straight from the output coaxial line and the other could be at right angles. Any angles physically possible would do as the voltage at the junction 3 can be split so that the TEM wave travels at any onwards angle.

To further match impedance, the junction 3 is an impedance matched junction. This comprises steps in the centre conductor diameter thereby varying the impedance of the coaxial line due to the change in distance to the outer conductor. This allows the impedance of the output coaxial line to be further matched to the further coaxial lines 34.

Typically, the output coaxial line has a 50 Ω impedance with a central conductor of molybdenum having a 1 mm diameter and an inside diameter of the outer conductor of 3 mm. The ceramic seals on windows 2 are of aluminium oxide or other suitable ceramic. The coaxial line after the ceramic windows could be any suitable cable, but a semi-rigid cable with semi-sintered powder dielectric is preferred. The overall dimensions of the divider arrangement are typically of the order 25 mm from the slow wave structure to the further output lines 34.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An electron beam tube of the type for amplification of RF signals comprising an electron gun, an interaction region within a vacuum, an RF input and an RF output arrangement, the RF output arrangement comprising an output coaxial line and a coaxial divider, wherein the coaxial divider is arranged to divide a signal on the coaxial line into a plurality of signals and wherein the vacuum within the interaction region extends into the coaxial divider.

2. An electron beam tube according to claim 1, wherein the coaxial divider comprises a plurality of further coaxial lines joined to the output coaxial line.

3. An electron beam tube according to claim 2, wherein the coaxial divider comprises a junction, which joins a central conductor of the output coaxial line to a central conductor of each of the plurality of further coaxial lines.

4. An electron beam tube according to claim 3, wherein the junction is arranged so as to impedance match the output coaxial line and the plurality of further coaxial lines.

5. An electron beam tube according to claim 4, wherein the junction is stepped so as to provide impedance matching.

6. An electron beam tube according to claim 1, wherein each of the plurality of further coaxial lines includes a seal to close the vacuum envelope.

7. An electron beam tube according to claim 6, wherein the seal comprises a ceramic material.

8. An electron beam tube according to claim 1, wherein the plurality of further coaxial lines are arranged substantially at right angles to the output coaxial line.

9. An electron beam tube according to claim 1, wherein the plurality of further coaxial lines consist of two opposed coaxial lines.

10. An electron beam tube according to claim 1, wherein the vacuum extends past a point of division of the signal and is terminated by a seal in each of the plurality of further coaxial lines, and each further coaxial line is coupled to an onward coaxial line.

11. An RF broadcast device comprising an electron beam tube according to claim 1, a housing and a plurality of antennas, one antenna coupled to each further coaxial line.

* * * * *